US005170724A

United States Patent [19]

Mogi

[11] Patent Number: 5,170,724

[45] Date of Patent: Dec. 15, 1992

[54] BURNING APPARATUS HAVING BURN PROMOTING PLATE

[75] Inventor: Kunitoyo Mogi, Togura, Japan

[73] Assignee: Moki Seisakusho Co., Ltd., Japan

[21] Appl. No.: 796,412

[22] Filed: Nov. 22, 1991

[30] Foreign Application Priority Data

Nov. 27, 1990 [JP] Japan ..... 2-327469

[51] Int. Cl.[5] ..... F23D 14/00

[52] U.S. Cl. ..... 110/235; 110/211; 110/240; 110/241; 126/147; 126/151

[58] Field of Search ..... 126/147, 148, 151; 110/211, 240, 241, 235

[56] References Cited

U.S. PATENT DOCUMENTS 596,028 12/1897 Girtanner ..... 126/224
3,043,248 7/1962 Martin ..... 110/211
4,700,637 10/1987 McCartney ..... 110/211 X

FOREIGN PATENT DOCUMENTS 277000 7/1964 Australia ..... 110/211

*Primary Examiner*—Edward G. Favors
*Attorney, Agent, or Firm*—McGlew and Tuttle

[57] ABSTRACT

There is disclosed a burning apparatus having a general burning chamber provided with an air-guide inlet for feeding air from above into the burning chamber and air-discharge outlet to which a funnel is connected. In said burning chamber, a burn-promoting plate formed with a suitable number of piercing holes is disposed from the ceiling of said burning chamber to halfway thereof toward the floor surface of the burning chamber.

Fuel or refuse thrown into said burning chamber is burnt from up to down and the burning operation is completed while giving rise to almost no smoke.

9 Claims, 5 Drawing Sheets

BURNING APPARATUS HAVING BURN PROMOTING PLATE

BACKGROUND OF INVENTION (1) Field of Invention

This invention relates to a in burning apparatus for use burning firewood or coal and various materials such as garbage or waste.

(2) Prior Art

It is extremely difficult to burn waste material, cardboard boxes, grass; bark or plastic pieces in a smokeless condition.

In general, a conventional burning apparatus is such that an air blower is attached to the burning chamber to receive fuel so as to forcibly supplying air or an auxiliary petroleum burner is provided so as to blow high-temperature burning gas on to the base of a funnel, thereby causing the smoke to be burnt again and again and attempting to achieve smokeless burning.

However, it is impossible to avoid smoking for a long period of time as the temperature inside the burning position is elevated beyond a predetermined level. Moreover, as is usual with plastic burning requiring a large amount of air for burning purposes, a long time is necessary until a smokeless condition is obtained.

At the same time, since the air blower or auxiliary burner requires a suitable electric source, there occurs such a drawback as restrictions on the site of use of burning apparatus. Furthermore since the burning apparatus tends to become complicated, it is expensive and the duration of its use becomes short in view of electric parts, accompanied by many disadvantages of high running costs due to the consumption of electricity.

Brief Summary of the Invention

According to the structure of the present invention, at an upper part of the burning chamber surrounded by a fire-resisting wall, for example, one side of the ceiling surface is constituted by an open and close lid body so that there are provided an air-supply opening for supplying air from above into the burning chamber and an air-discharge outlet formed on the ceiling surface or the side surface opposite to said air-supply opening, a funnel being connected to said air-discharge outlet.

Then, a burn-promoting plate is hung down from the ceiling surface so as to separate said air discharge outlet from said air-supply opening with some clearance between the lower end of said burn-promoting plate and the floor surface of the burning chamber whereby the inside of the burning chamber can be partitioned into a primary burning chamber at the side of said air-supply opening and a secondary burning chamber at the side of said air-discharge outlet in mutual communication through said clearance, and moreover said burn-promoting plate is formed with a large number of piercing holes, all of which are thus characteristic of the present invention.

Object of the Invention

The principal object of the invention is to provide a burning apparatus such as a stove or an incinerator without consuming any energy in the form of auxiliary burning means, such burning apparatus being designed to cause no smoke at all by perfect burning except for a period of initial ignition.

Another object of the invention is to provide a burning apparatus wherein no manual operation is required after ignition until an end without burnt residue and take-out operation of ash and funnel sweeping is not required so often as is the case with a conventional apparatus, and thus the burning apparatus of the present invention becomes easy to maintain.

All other objects will be apparent from the following description.

DETAILED DESCRIPTION OF THE INVENTION

Figure 1:
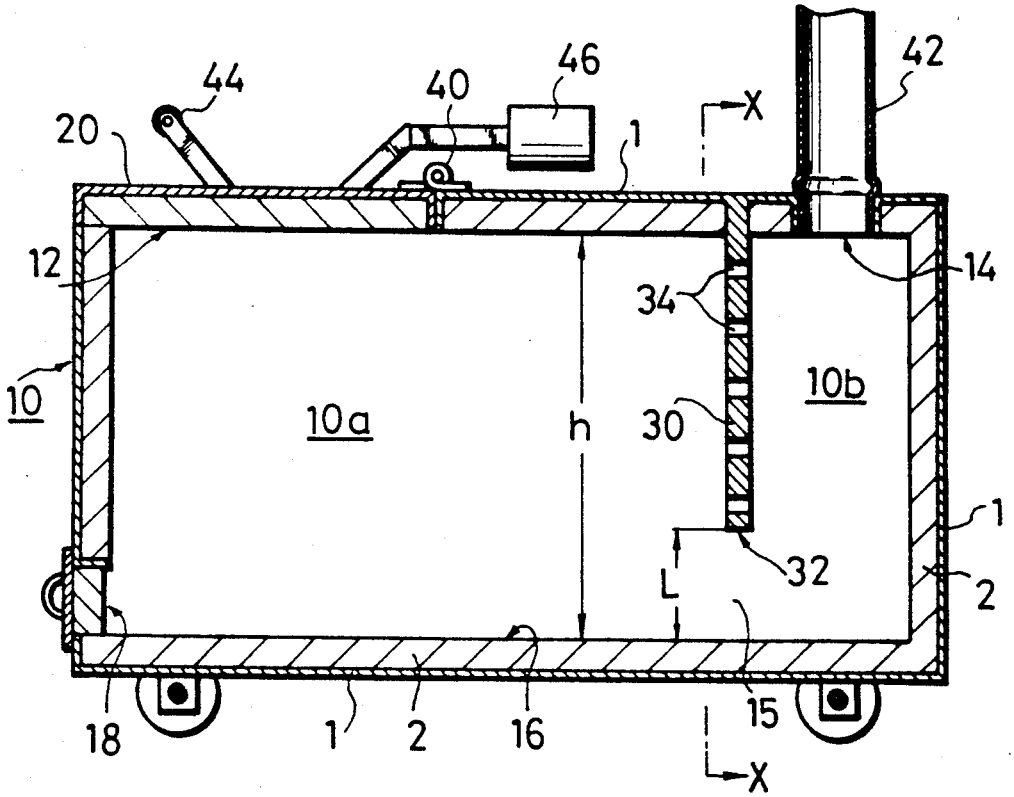
FIG. 1 is a cross-sectional view of a preferred embodiment of the present invention.
Figure 2:
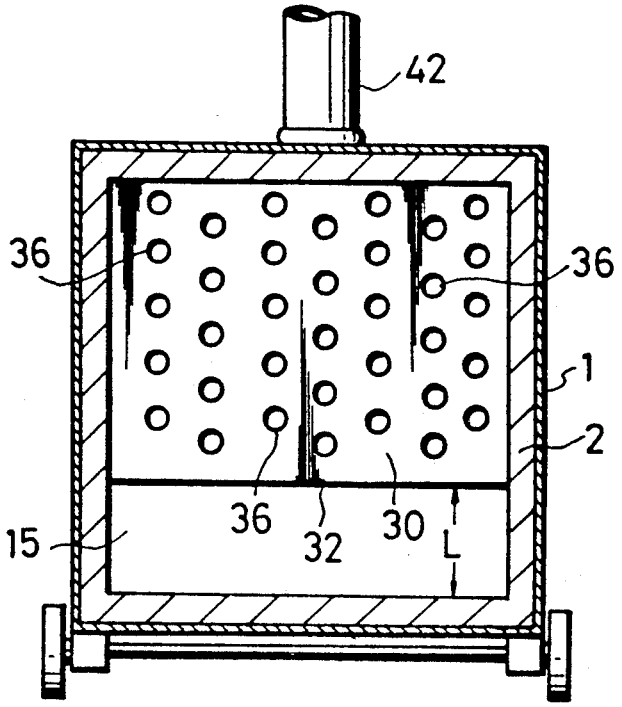
FIG. 2 is a cross-sectional view taken along line X—X of FIG. 1.

FIG. 1 shows a cross section of a preferred embodiment of the burning apparatus which is particularly suitable for incineration of various kinds of refuse or waste, according to the present invention.

The burning apparatus shows a box-shape burning chamber 10 consisting of an outer galvanized plate 1 with its inside covered by a refractory material 2.

One half of the ceiling surface of the burning chamber 10 is constituted by a lid body 20 wherein it is rotated upwardly around a hinge 40 as the center so as to open an inlet 12 for supply of refuse, said inlet concurrently serving as an air-supply opening.

The other side 11 of the ceiling surface is integrally connected to the upper of the burning apparatus and there is formed a discharge opening 14 in a position farthest away from said inlet 12.

A funnel 42 is connectively inserted in the discharge opening 14. A burn-promoting plate 30 is hung down from the ceiling wall between said discharge opening 14 and said inlet 12 so that the lower end 32 of the burn-promoting plate 30 remains with a clearance 15 of the required distance L, and in this case, said distance L is most preferably selected as $\frac{1}{3} \sim \frac{1}{4}$ of the height (h) of the burning apparatus.

The burn-promoting plate 30 is formed with a large number of piercing holes 34, 34, . . . so that the primary burning chamber 10*a* with the inlet 12 to open therein is arranged in communication with the secondary burning chamber 10*b* with the discharge outlet 14 to open therein.

Numeral 18 is an ash take-out outlet to open in the lower part of the lateral wall of the primary burning chamber 10*a*. Numeral 44 is a handle attached to the end edge 21 of the lid body. Numeral 46 is a balance weight for facilitating opening and closing movements of the lid body.

In the burning apparatus shown as the aforesaid preferred embodiment, refuse is thrown into the primary burning chamber and the upper part of the refuse is ignited. In this case, air can be supplied by holding the lid body 20 in somewhat raised condition. A recess 23 is formed at the other lateral edge 22 of the lid body 20 and a polygonal support piece 25 is rotatably supported by a pin 24 disposed in said recess.

The weight of the lid body 20 is borne by said support piece 25 pressing against the upper surface of circumferential edge 13 of the inlet 12 so that a clearance can be maintained therebetween.

The distance between the pin 24 and the botthom surface of the support piece 25 is changed by suitably rotating the latter, so that it is possible to adjust the amount of supplied air.

Figure 3:
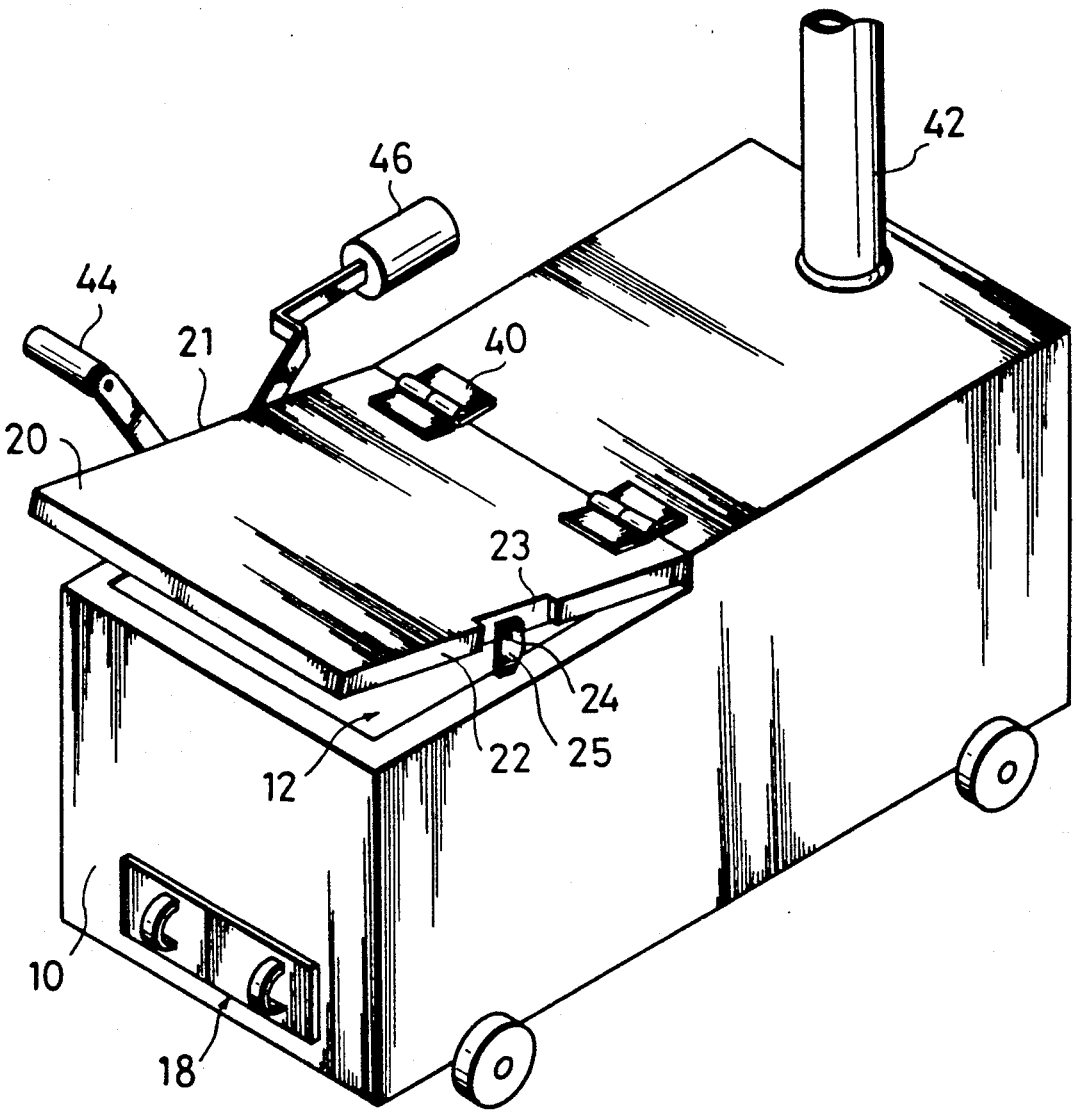
FIG. 3 is a perspective view showing the outline of the preferred embodiment of FIG. 1.

After ignition of the refuse, when the amount of air is adjusted by maintaining the lid body 20 with a suitable clearance as shown in FIG. 3, the smoke, if any, will be suppressed very soon (usually in 1~2 minutes), thereby rapidly causing a smokeless condition.

When the burning condition becomes normal, the greater part of the burnt flow in the primary burning chamber will flow into the secondary burning chamber through the clearance 15 below the burn-promoting plate. At this instant, the burn-promoting plate has grown red-heated and then high-temperature air is supplied into the secondary burning chamber **10*b*** through the piercing holes of the burn-promoting plate thus red-heated, until the inside of the secondary burning chamber assumes a perfectly burnt condition.

Figure 4:
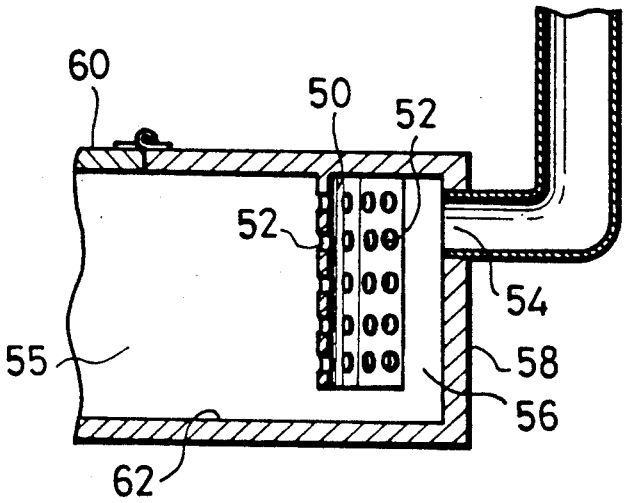
FIG. 4 is a cross-sectional view showing the main parts of another preferred embodiment of the invention.

In the aforesaid preferred embodiment, the burn-promoting plate is exemplified as a flat plate but it may be a burn-promoting plate 50 of a curved surface formed with passage holes 52, 52, . . . and at the same time, a discharge outlet 54 may also be disposed at the lateral surface 58 of a secondary burning chamber 56, as shown in FIG. 4.

In this case, numeral 60 is a lid body, 62 the floor surface of the burning chamber and 55 a primary burning chamber. Although the shape of the burning chamber is exemplified in the form of a rectangular box, yet needless to say, it may be cylindrical, to begin with, and various shapes are also available for use.

Likewise, the inner wall of the burning chamber may be made of metal and the external surface thereof may be surrounded by an external wall of metal so as to form a water chamber around the burning chamber so that such an assembly can be used as a hot water boiler.

Moreover, the lid body is not always rotational but it may be opened or closed by sliding on the circumferential edge of the refuse supply inlet.

The diameter of piercing holes formed in the burn-promoting plate is within the range of 10~25 mm, thereby causing the best burning condition. When the proportion of area of the piercing holes to occupy in the burn-promoting plate (open percentage) is within 10~25%, the effect of the burn-promoting plate is outstanding and also the distribution of such piercing holes is found most effective in the case of their arrangement at equal intervals.

At the same time, the volume of the secondary burning chamber is recommended to show the range of ⅓~1/5 of that of the primary burning chamber, in order to obtain a satisfactory condition.

Figure 5:
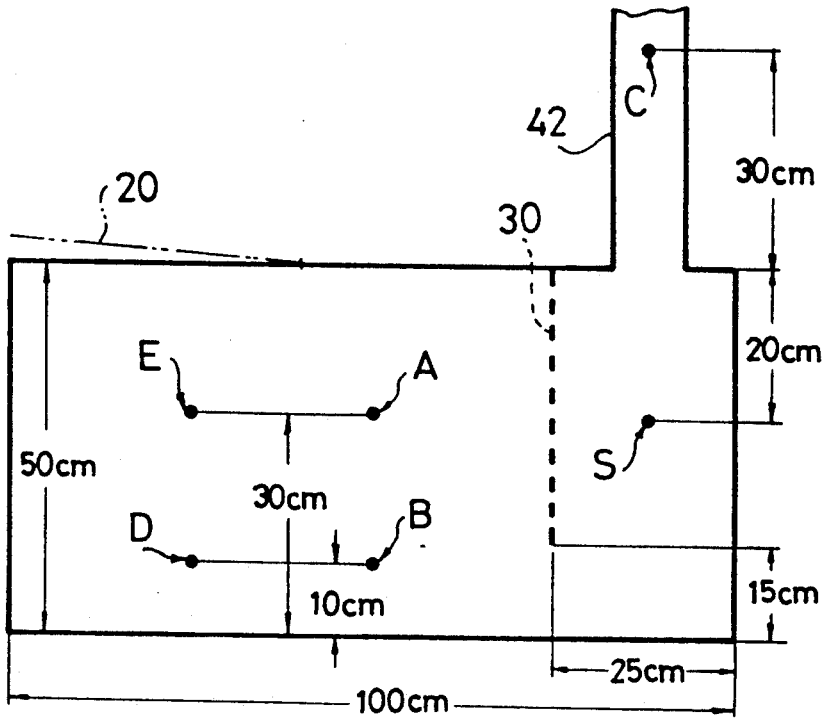
FIG. 5 is an illustrative view showing points of measurement of temperature in the burning apparatus in tests for detection of the effect of the fire-promoting plate, according to the invention.

Next, comparative tests were made in the use of a burning apparatus having the structure shown in FIG. 1 and the size (volume 300 liters) shown in the FIG. 4 and also a burn-promoting plate in a position shown by the broken line FIG. 5 and another burning apparatus of the same conditions as those of the former burning apparatus except without a burn-promoting plate provided, wherein 10 Kg. of waste cardboard boxes were thrown into both said burning apparatus respectively and temperatures of points A~E were measured shown in FIG. 5. The open percentage of the burn-promoting plate (which was made of cast iron) was 16%.

Figure 6:
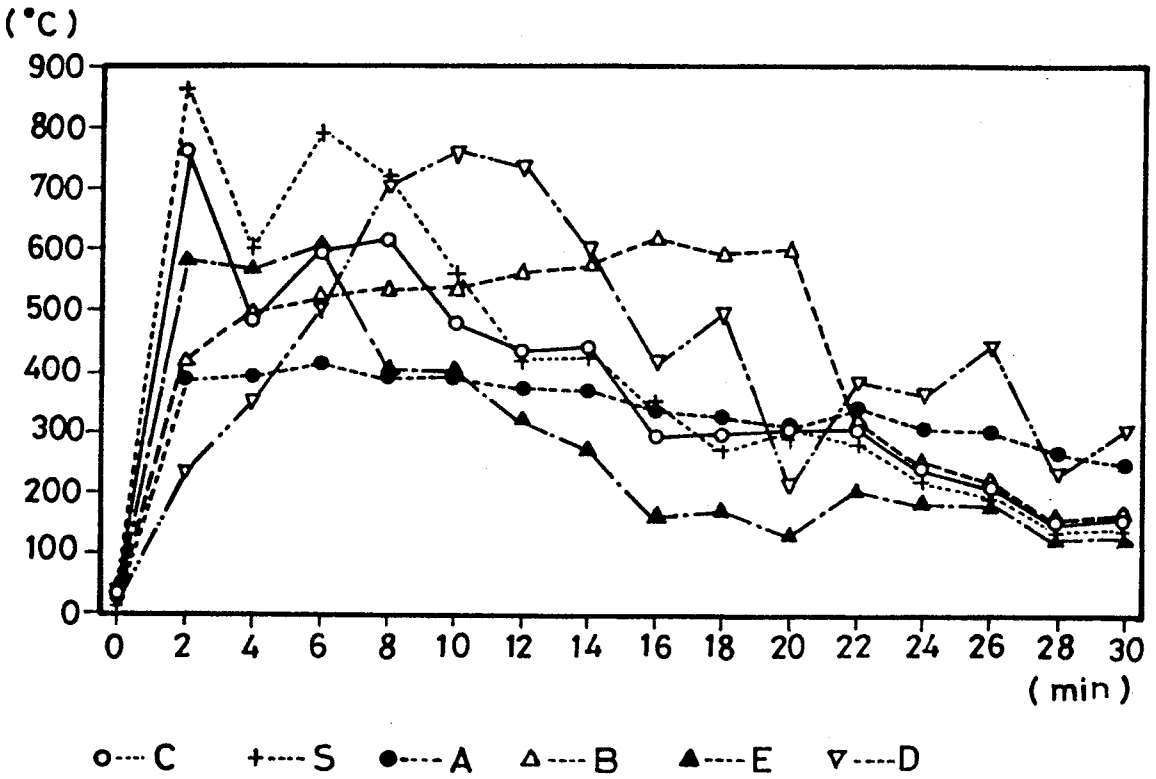
FIG. 6 is a graph showing changes in time temperature distribution in the burning apparatus of the invention.
Figure 7:
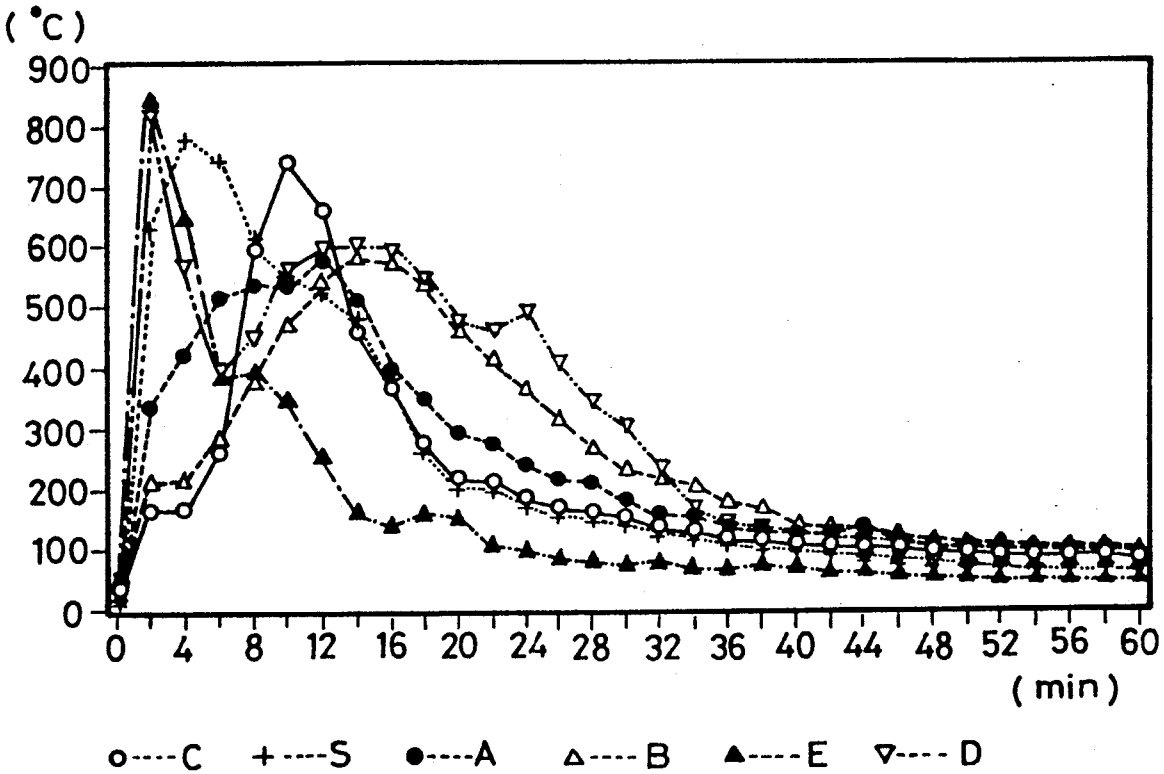
FIG. 7 is a graph showing changes in time in burning temperature distribution by removing the fire-promoting plate from the burning apparatus of the invention.

The results of such tests are illustrated in FIGS. 6 and 7. So is apparent from the drawings, the burn-promoting plate was found to have two outstanding effects of urging the burning operation slowly and maintaining high temperatures for a long period of time in the former burning apparatus whereby sufficient air could be supplied to the burnt air flow and almost no smoke was issued forth from the funnel until burnt materials were reduced to white ash as the final phase.

On the other hand, in the case of the latter burning apparatus without a burn-promoting plate, despite the supply of air from above, abrupt burning started and smoke was issued forth for a while and thereafter the temperature inside the burning apparatus was lowered rapidly until black coal was caused to remain.

Thus, the burning apparatus of the present invention proved to ensure that the burning advances downwardly from the upper surface of waste or refuse thrown into the primary burning chamber and therefore, even at initial stage of ignition, extremely little smoke was generated and then along with the expansion of burning, said burn-promoting plate well served to prevent rapid expansion of burning, controlled the speed of burning, and maintained high temperatures in the primary burning chamber and along with further progress of burning, said burn-promoting plate grew red-heated so that it served as a burning catalyst and acted to maintain high temperature also in the secondary burning chamber and high-temperature air for supply to the narrow secondary burning chamber could feed sufficient air universally and uniformly into the secondary burning chamber without lowering the temperature inside there of until the burnt flow could be burnt completely and conveyed to the discharge outlet.

In this way, since no burnt residue remains in the burning apparatus of the present invention, there occurs almost no mixture of unburnt black carbonized residue in ash, contrary to conventional burning apparatus, and at the same time, the amount of ash is quite little, moreover, sweeping of the funnel is almost unnecessary, while conventional burning apparatus requires its funnel to be swept once a month or a month and a half, so that the burning apparatus of the present invention becomes extremely easy to maintain and administer, compared to conventional burning apparatus.

What is claimed is:

1. A burning apparatus, comprising:

a housing defining a general burning chamber with an upper ceiling surface and a lower horizontal material support surface, extending continuously from one end of said housing to another end of said housing; an air supply inlet provided through said upper ceiling surface at one end of said housing and a discharge outlet disposed at one of said upper ceiling surface and a lateral wall of said housing, at an end of said housing opposite said air supply inlet, said discharge outlet being connected to a funnel; a burn promoting plate extending from said upper ceiling surface downwardly to a point spaced above said lower horizontal material support surface of said chamber, said burn promoting plate providing a partition of said chamber into a primary burning chamber, below said air supply inlet, and said secondary burning chamber in a region of said discharge outlet, whereby said spacing between burn-promoting plate and said lower surface provides communication between said primary burning chamber and said secondary burning chamber and said burn-promoting plate acts to heat gases as they pass from said primary burning chamber to said secondary burning chamber.

2. A burning apparatus according to claim 1, wherein said burn-promoting plate is formed with a plurality of piercing holes allowing gas to pass through said burn-promoting plate whereby gas is heated by said burn-promoting plate.

3. A burning apparatus according to claim 2, wherein said piercing holes provide an open percentage of said burn-promoting plate forming 10–25 percent of an area of said burn-promoting plate.

4. A burning apparatus according to claim 1, wherein said burn-promoting plate is formed of one of a red-heatable metal or ceramic.

5. A burning apparatus, comprising:

a housing defining a general burning chamber, said housing having an upper ceiling wall and a lower floor surface; an air supply inlet including a door member formed in said ceiling wall for intake of air through said ceiling wall; a discharge outlet formed through one of said ceiling wall and a lateral wall of said housing, said discharge outlet being provided spaced away from said air supply inlet, said discharge outlet being connected to a funnel; a burn-promoting plate connected to said ceiling wall and extending downwardly from a general burning chamber ceiling surface of said ceiling wall to a location spaced a distance from said lower surface to define a clearance between the lower edge of said burn-promoting plate and said lower surface, said burn-promoting plate partitioning said general burning chamber into a primary burning chamber below said air supply inlet and a secondary burning chamber in a region of said discharge outlet, said primary burning chamber including a plurality of piercing holes forming from 10 to 25 percent of an area of said burn-promoting plate, said piercing holes cooperating with said clearance to form an air passage for heating gases passing between said primary burning chamber and said air supply inlet.

6. A burning apparatus according to claim 5, wherein said lower surface defines a burning chamber base for burning of material placed in said primary burning chamber, said floor surface being continuous and uninterrupted from said primary burning chamber to said secondary burning chamber and lying in a single horizontal plane.

7. A burning apparatus according to claim 6, wherein said air-supply inlet is defined by a door element forming a part of said ceiling portion, support means being provided for maintaining said door in a partially opened position to provide said air inlet.

8. A burning apparatus, comprising:

a housing defining a general burning chamber, said housing including a lower continuous floor surface lying substantially in a horizontal plane and including a ceiling portion with a door element pivotable about hinges, providing access into said chamber; door support means for providing an air inlet opening into said chamber, between said door element and walls of said housing, said support means being adjustable to vary an opening amount of said air inlet opening; a discharge outlet provided through one of said ceiling and a lateral wall of said housing, said discharge outlet being connected to a funnel; burn-promoting plate means for partitioning said general burning chamber into a primary burning chamber below said air-supply inlet and a secondary burning chamber in an area of said discharge outlet and for defining a gas passage between said primary burning chamber and said secondary burning chamber wherein gas passing through said passage is heated by heat transfer between said burn-promoting plate and said gas passing between said primary burning chamber and said secondary burning chamber, said passage including a clearance formed between a lower end edge of said burn-promoting plate and said floor surface and said also including a plurality of piercing holes formed in said burn-promoting plate.

9. A burning apparatus according to claim 2, wherein said burn-promoting plate is formed as a curved surface surrounding said discharge outlet.

* * * * *